US006150596A

United States Patent [19]

Hsieh

[11] Patent Number: 6,150,596

[45] Date of Patent: Nov. 21, 2000

[54] ADJUSTABLE PEDAL FOR A DRUM

[76] Inventor: Wu-Hong Hsieh, No. 162, Chung-Shan 2 Rd., Luchou Hsiang, Taipei Hsien, Taiwan

[21] Appl. No.: 09/392,422

[22] Filed: Sep. 9, 1999

[51] Int. Cl.[7] ..... G10D 13/02

[52] U.S. Cl. ..... 84/422.1; 84/422.2

[58] Field of Search ..... 84/422.1, 422.2, 84/422.3

[56] References Cited

U.S. PATENT DOCUMENTS 4,782,733 11/1988 Herring ..... 84/422.1

*Primary Examiner*—Robert E. Nappi
*Assistant Examiner*—Shihyung Hsieh
*Attorney, Agent, or Firm*—Merchant & Gould P.C.

[57] ABSTRACT

An adjustable pedal for a drum includes a base having two lugs extending therefrom, a pedal with two adjusting bars pivotally attached thereto each attached to a lug on the base, an adjusting device with an axle securely received therein and pivotally mounted on the base, a chain with one end attached to the adjusting device and the other end attached to the pedal and two supporting bars extending from the base each with a through hole to receive the axle therein. The two adjusting bars each includes multiple indents aligning with each other to receive the lug of the base.

3 Claims, 3 Drawing Sheets

ADJUSTABLE PEDAL FOR A DRUM

BACKGROUND OF THE INVENTION

1. Field of the Invention

The present invention relates to a pedal for a drum, and more particularly, to an adjustable pedal for a drum.

2. Description of the Related Art

A conventional pedal is set beside the drum. It often moves while using because the frictional resistance between the pedal and ground is not enough to position the pedal in place. In such a manner, the user has no choice but to take the pedal back again and again. For this reason, a new pedal which has a metal plate attached thereto is peddled publicly and thereby increase weight and steady of the pedal. However, the pedal with a metal plate is heavy besides occupying space while moved. In addition to weight and steady, the conventional pedal still has other problems.

The conventional pedal includes a adjustable plate attached to the bottom thereof and connecting to a base to adjust the position of the pedal, by means of adjusting the angle of the base and the adjustable plate. Essentially, the adjusting device connects with the base an can not be folded, so the pedal will occupy a certain space when the drum need to be moved or collected, A conventional pedal (60) in accordance with the prior art shown in FIG. 3 comprises a base (61) and two supporting bars (62) each with a through hole (621) attached to the base (61). A drive device (50) has an axle (51) securely received therein and pivotally received in the through hole (621) of the supporting bar (62). The pedal (60) has a first end and a second end with the first end pivotally connected to the base (61). The base (61) further includes a chain (63). The chain (63) has a first end attached to the drive device (50) and a second end connected to the second end of the pedal (60).

It is extremely difficult to change the angle of the pedal (60), because the drive device (50) is securely attached to the base (61) by the supporting bar (62) and the pedal (60). So, this drive device (50) can not provide a convenient and simple method of adjusting the pedal (60) of a drum.

The present invention has arisen to mitigate and obviate the disadvantage of the conventional pedal (60).

BRIEF SUMMARY OF THE INVENTION

In accordance with one aspect of the present invention, an adjustable pedal for a drum is provided. The adjustable pedal for a drum includes a base that has two lugs extending therefrom, two adjusting bars pivotally mounted thereon and connecting to the base and an adjusting device with an axle securely received therein and pivotally mounted on the base.

Accordingly, the structure of the present invention can change the angle of the pedal easily by using the multiple indents in the adjusting bar and the lugs on the base. Because an user only has to put the indent over the lug to securely attach the pedal to the base. When the pedal needs to be stored after using, an user only needs to detach the adjusting bar from the lug and lift the pedal and the adjusting bar to abut the adjusting device. Then the pedal has a smaller volume than that of the conventional being folded because the pedal is substantially perpendicular to the base.

Further benefits and advantages of the present invention will become apparent after a careful reading of the detailed description with appropriate reference to the accompanying drawings.

DETAILED DESCRIPTION OF THE INVENTION

Figure 1:
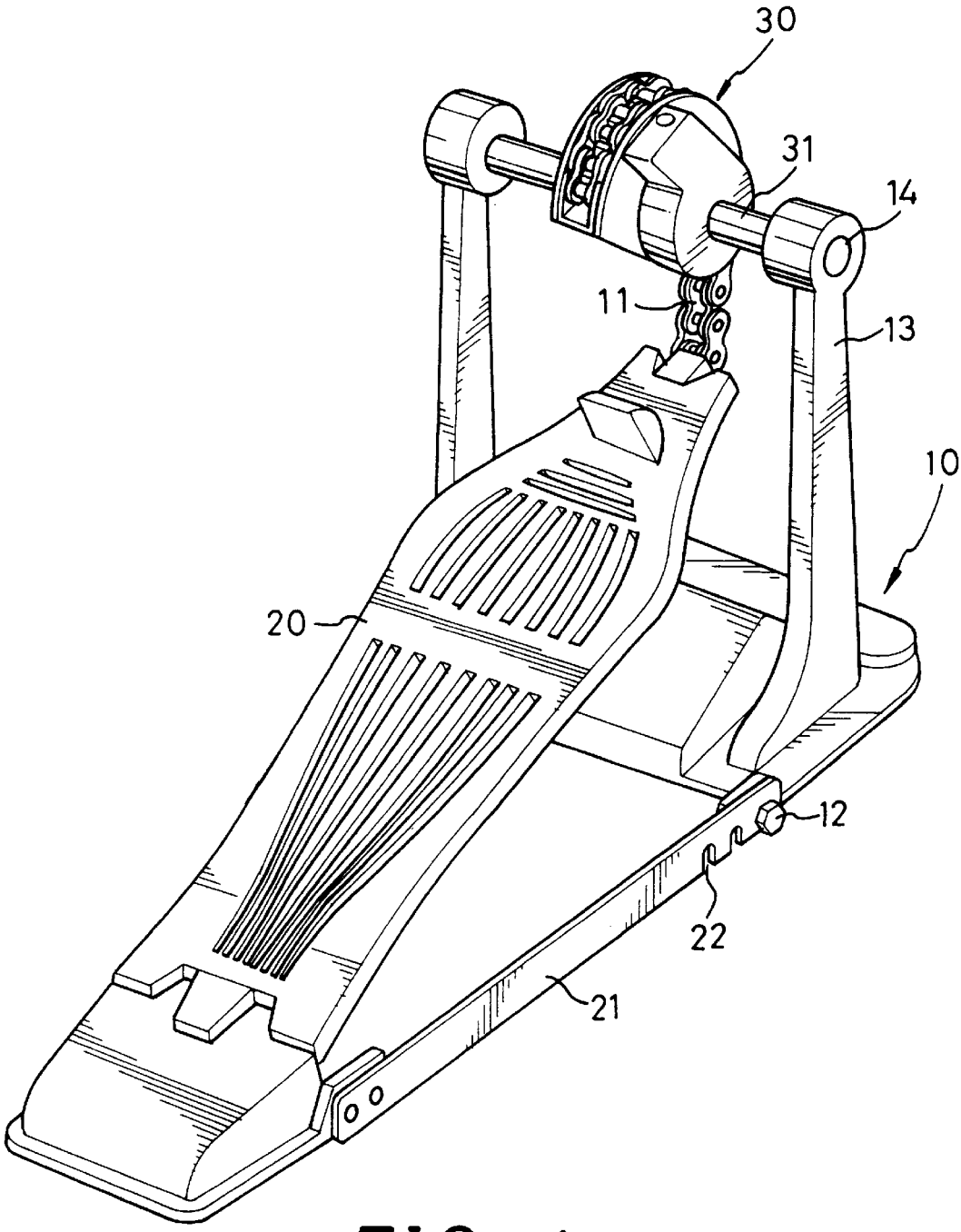
FIG. 1 is a perspective view of a drum pedal in accordance with the present invention.

Referring to FIG. 1, an adjustable pedal for a drum in accordance with the present invention comprises a base (10) having a lug (12) extending from each side. A pedal (20) includes two adjusting bars (21) pivotally mounted thereon and attached to the base (10). An adjusting device (30) pivotally mounted on the base (10) has an axle (31) securely received therein.

The adjusting device (30) includes a chain (11) having one end attached to the adjusting device (30) and the other end attached to the pedal (20). The base (10) has two supporting bars (13) extending therefrom, each having a through hole (14) to receive the axle (31) therein. The two adjusting bars (21) of the pedal (20) each includes multiple indents (22) aligning with each other to receive the lugs (12) of the base (10).

The pedal (20) is connected to the adjusting device (30) by the chain (11). So, a user only needs to detach the adjusting bars (21) from the lugs (12) and choose suitable indents (22) to attach again when adjusting the angle of the pedal (20). The pedal (20) remains stable because the adjusting bar (21) abuts the ground along its entire length when the pedal (20) is in use.

Figure 2:
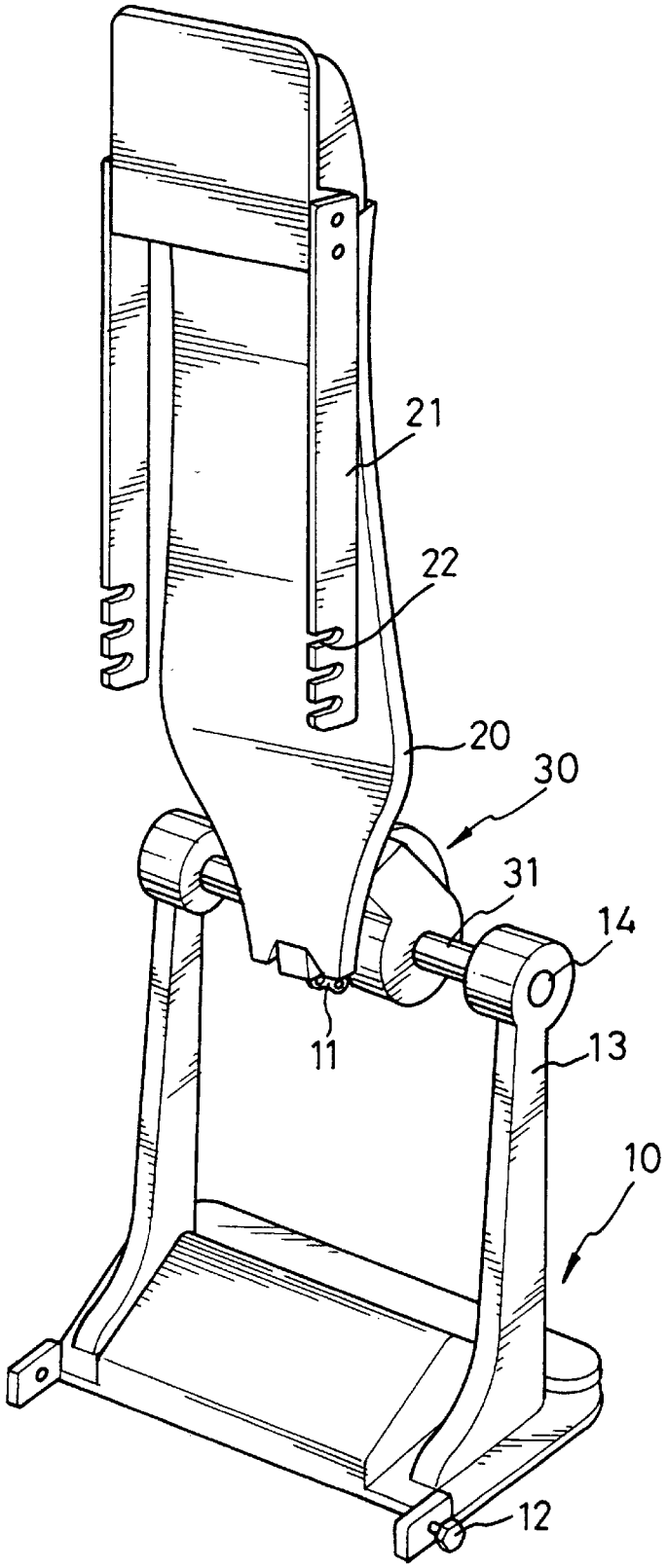
FIG. 2 is a perspective view of the drum pedal in FIG. 1 in a folded state.
Figure 3:
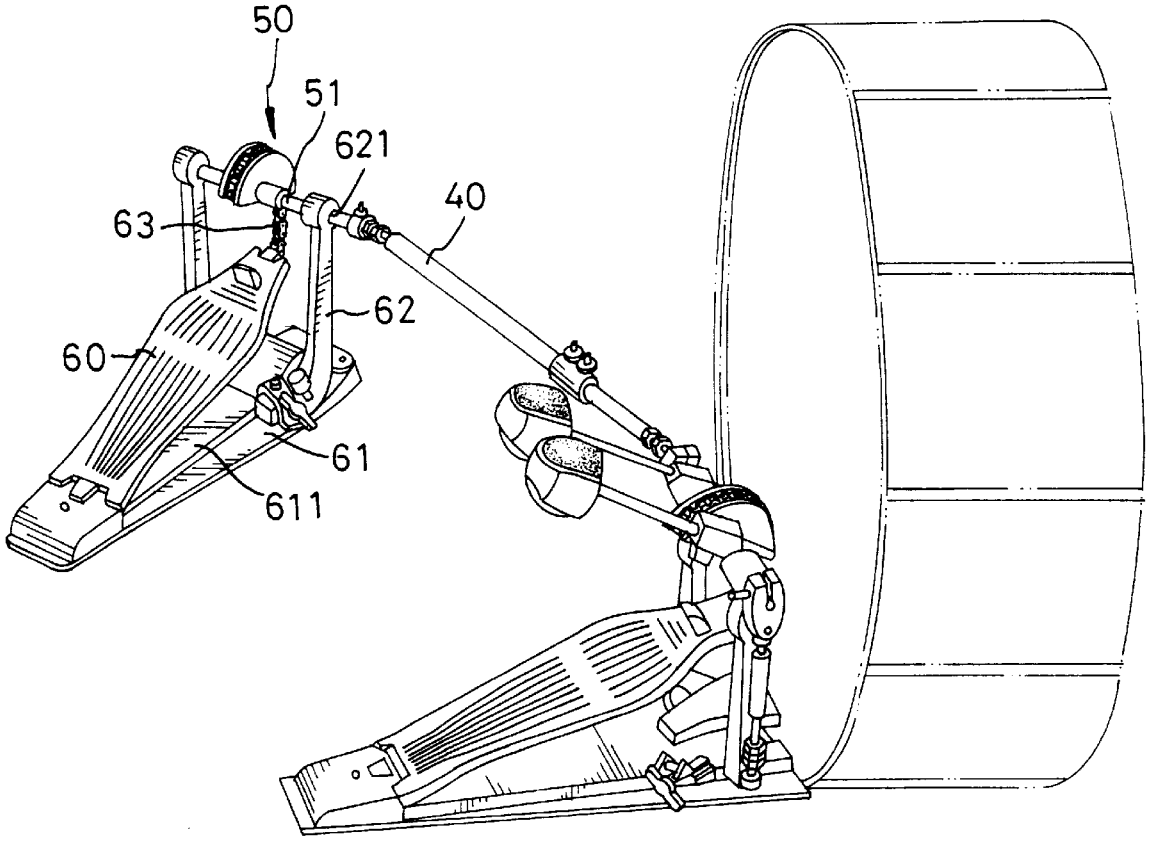
FIG. 3 PRIOR ART
FIG. 3 is a perspective view of a conventional drum pedal.

Referring to FIG. 2, to store the pedal after using, an user only needs to detach the adjusting bar (21) from the lug (12) and lift the pedal (20) and the adjusting bar (21) to abut the adjusting device (30). The pedal (20) has a smaller volume than that of the conventional pedal (60) (referring to FIG. 3) when folded, because the pedal (20) is substantially perpendicular to the base (10).

The adjustable pedal for a drum of present invention has several advantages comprising:

1. The structure is simple. By using only the indents (22) in the adjusting bar (21) and the lugs (12) on the base (10) the angle of the pedal is easily changed. The structure also uses significantly less material during the manufacturing process;
2. Space saving; A user can fold the pedal (20) easily after use; and
3. Easy operation; Because the pedal (20) has a simple structure, an user only has to put the indent (22) over the lug (12) to securely attach the pedal (20) to the base (10).

Although the invention has been explained in relation to its preferred embodiment, it is to be understood that many other possible modification and variation can be made without departing from the spirit and scope of the invention as hereinafter claimed.

What is claimed is:

1. An adjustable pedal for a drum comprising:

a base having two lugs extending therefrom;

a pedal having two adjusting bars pivotally mounted thereon and connecting to said base, said two adjusting bars each including multiple indents aligning with each other to receive said lugs of said base; and an adjusting device pivotally mounted on said base having an axle securely received therein.

2. The adjustable pedal for a drum in accordance with claim 1, wherein said base includes a chain having one end attached to said adjusting device and the other end attached to said pedal.

3. The adjustable pedal for a drum in accordance with claim 1, wherein said base includes two supporting bars extending therefrom, each having a through hole to receive said axle therein.

* * * * *